United States Patent [19]

Kiyohara et al.

[11] Patent Number: 4,847,149

[45] Date of Patent: Jul. 11, 1989

[54] BASE FOR REFLECTION-PHOTOGRAPHIC ELEMENTS

[75] Inventors: Kazuto Kiyohara; Yoshiyuki Funabashi; Naoko Shimomura, all of Tokyo, Japan

[73] Assignee: Konica Corporation, Tokyo, Japan

[21] Appl. No.: 115,863

[22] Filed: Nov. 2, 1987

[30] Foreign Application Priority Data

Nov. 5, 1986 [JP] Japan ..... 61-264662

[51] Int. Cl.[4] ..... B32B 7/00

[52] U.S. Cl. ..... 428/332; 428/402; 428/480; 428/913; 430/512; 430/533; 430/DIG. 933

[58] Field of Search ..... 430/512, 533, DIG. 933; 428/480, 402, 332, 913

[56] References Cited

U.S. PATENT DOCUMENTS 4,336,326 6/1982 Evans ..... 430/933
4,628,025 12/1986 Komaita et al. ..... 430/533

FOREIGN PATENT DOCUMENTS 1100579 1/1968 United Kingdom .
1563591 1/1986 United Kingdom .

OTHER PUBLICATIONS

"Optically brightened subbing for photographic materials" Research Disclosure Oct. '79 p. 573 by Bellinger et al.

*Primary Examiner*—Edith Buffalow
*Attorney, Agent, or Firm*—Finnegan, Henderson, Farabow, Garrett and Dunner

[57] ABSTRACT

A base for reflection-photographic elements is disclosed which has a biaxially stretched film support, said film comprising polyester resin and titanium dioxide, wherein said film contains at least one compound represented by the following general formula (I) or (II).

(I)

wherein $R_1$, $R_2$, $R_3$, $R_4$ and $R_5$ each represents a hydrogen atom, a halogen atom, an unsubstituted or substituted alkyl group, an alkoxy group, a dialkylamino group or an aryl group, provided that $R^1$, $R^2$, $R^3$ and $R^4$ may cooperate to form a ring.

(II)

wherein A represents —CH=CH—, and $R_6$, $R_7$, $R_8$ and $R_9$ each represents a hydrogen atom, a halogen atom, an unsubstituted or substituted alkyl group, an alkoxy group, a dialkylamino group or an aryl group, provided that $R_6$ and $R_7$, and $R_8$ and $R_9$ each may cooperate to form a ring.

19 Claims, No Drawings

BASE FOR REFLECTION-PHOTOGRAPHIC ELEMENTS

BACKGROUND OF THE INVENTION

The present invention relates to a base for reflection-photographic elements which are photographic elements that have photographic layers formed on bases made of opaque reflecting materials. Reflection-photographic elements typically include those which are generally referred to as "photographic papers".

Polyethylene-coated paper has been conventionally used as a base for reflection-photographic elements and it consists of pulp-made raw paper coated with a polyethylene layer containing a white pigment. One disadvantage of polyethylene-coated paper is that a reflection-photographic element using it as a base has a grained and rippled glossy surface due to the asperities of the surface of raw paper and this impairs greatly the brightness and sharpness of a photographic image and, hence, the aesthetic appeal that is desirably attained by these attributes. Another disadvantage is that although both sides of the base are coated with a water-impermeable polyethylene layer, the edges that are produced by cutting are uncoated and processing solutions such as developer will get into and remain in the base to cause discoloration of the final print.

In order to eliminate these disadvantages, Japanese Patent Application (OPI) No. 114921/1974, Japanese Patent Publication No. 5104/1980, British Patent Nos. 1,563,591, 1,563,592, Japanese Patent Publication No. 4901/1981, Japanese Patent Application (OPI) No. 118746/1986 and other patents have proposed bases for reflection-photographic elements that are made of thermoplastic resin films containing white pibments. Titanium dioxide, which has good hiding power, is preferred as a white pigment and polyester resins having properties suitable for photographic are preferred thermoplastic resins. Titanium dioxide compounds are available in two types, rutile and anatase. Rutile titanium dioxide has high weather resistance but is excessively yellowish in color. Anatase titanium dioxide is less yellowish but is not high in weather resistance and upon standing, especially in sunshine, it will turn yellow, and even dark brown, by decomposing the resins around the particles of titanium dioxide.

SUMMARY OF THE INVENTION

An object, therefore, of the present invention is to provide a base for reflection-photographic elements that is made of a titanium dioxide containing polyester film which possessses no yellow tinge and is satisfactorily protected against yellowing over time.

This object of the present invention can be attained by a base for reflection-photographic elements having a biaxially stretched film support, said film comprising polyester resin and titanium dioxide, wherein said film contains at least one compound represented by the following general formula (I) or (II):

(I)

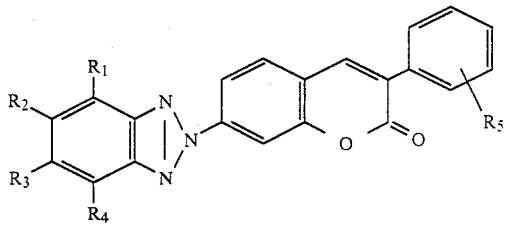

wherein $R_1$, $R_2$, $R_3$, $R_4$ and $R_5$ each represents a hydrogen atom, a halogen atom, an unsubstituted or substituted alkyl group, an alkoxy group, a dialkylamino group or an aryl group, provided that $R_1$, $R_2$, $R_3$ and $R_4$ may cooperate to form a ring.

(II)

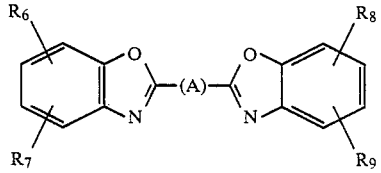

wherein A represents —CH=CH—,

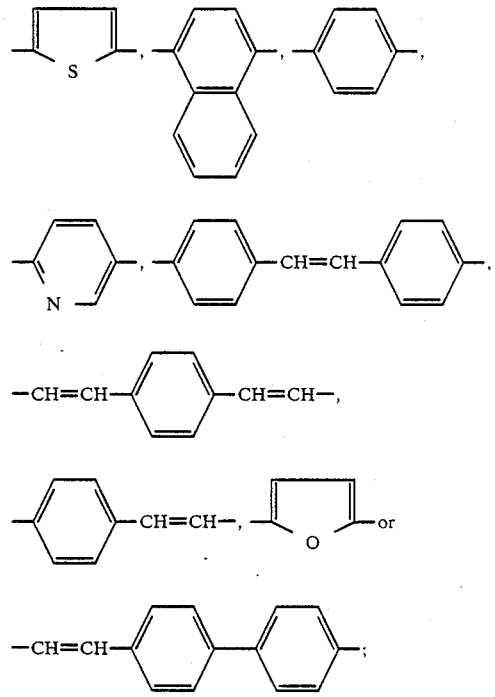

and $R_6$, $R_7$, $R_8$ and $R_9$ each represents a hydrogen atom, a halogen atom, an unsubstituted or substituted alkyl group, an alkoxy group, a dialkylamino group or an aryl group, provided that $R_6$ and $R_7$, and $R_8$ and $R_9$ each may cooperate to form a ring.

DETAILED DESCRIPTION OF THE INVENTION

The polyester resin that can be used in the present invention may include other polymers and suitable additives to such an extent that the resin characteristics of polyesters will not be affected when used in practical applications.

Illustrative polyester resins that can be used in the present invention include polymers of the condensation products of aromatic dicarboxylic acids (e.g., terephthalic acid, isophthalic acid, phthalic acid, and naphthalenedicarboxylic acid) and glycols (e.g., ethylene glycol, 1,3-propanediol, and 1,4-butanediol), such as polyethylene terephthalate, polyethylene-2,6-dinaphthalate, polypropylene terephthalate, polybutylene terephthalate, and copolymers thereof.

For the purposes of the present invention, polyethylene terephthalate (hereinafter abbreviated as PET) is preferably used as a polyester resin. PET resin films are impermeable to water, have a high degree of smoothness, display good mechanical characteristics in such aspects as tensile strength and tear strength, are high in dimensional stability, and offer high chemical resistance during development and other steps of photographic processing.

The resin used in the present invention preferably has an intrinsic viscosity of 0.4–1.0, more preferably 0.5–0.8, when measured at 20° C. in a mixed solvent of phenol and tetrachloroethane (60/40 in weight ratio).

Titanium dioxide used in the present invention as a white pigment is in the form of surface-treated particles that have an average size of 0.1–0.5 μm and which do not contain a substantial amount of particles larger than 50 μm. Such titanium dioxide preferably occupies at least 90 wt % of all of the white pigments used in the present invention. Titanium dioxide is subjected to a surface treatment for the purpose of providing its particles with increased affinity for the resin used in the present invention. Suitable surface treatments are: treating the particles of titanium dioxide with an aluminum compound (e.g., alumina) having an oxygen bond or a hydroxy bond and/or a silicon compound (e.g., silicic acid); and the same treatment as described above except that it is followed by surface treatment with a suitable material such as a metal soap, a surfactant or a coupling agent.

Anatase titanium (IV) dioxide is preferably used in the present invention. Titanium dioxide has a refractive index (n) of 2.5–2.75 which is much higher than that of the resin to be used in the present invention (e.g., PET has a refractive index of 1.66), so if it is employed in a photographic base, it will permit high reflectance of light to achieve a better resolution of the finally obtained photographic image.

The titanium dioxide used in the present invention is comprised of particles having an average size of 0.1–0.5 μm and does not contain a substantial amount of particles larger than 50 μm. If the average size of titanium oxide particles exceeds 0.5 μm, they will not be able to provide an effective degree of reflectance, opacity or whiteness. If titanium dioxide contains a substantial amount of particles larger than 50 μm, a resin film incorporating such titanium dioxide will easily tear when it is subjected to an external force in such operations as film shaping and stretching. As further problems, the film will not have a satisfactory degree of smoothness or gloss and will lose the inherent mechanical strength of the polyester resin. In addition, a satisfactory photographic material cannot be obtained even if photographic layers are provided on a base using such unduly large titanium dioxide particles because the latter will appear as defects in the final photographic image. Therefore, particles larger than 50 μm in size should be substantially absent from the titanium dioxide used in the present invention. What is more, titanium dioxide particles should be uniformly dispersed in the resin in such a way that they will not agglomerate to form secondary particles larger than 50 μm.

Titanium dioxide is preferably incorporated in the resin in an amount of at least 10 wt % of the resin composition in order to satisfy the requirements for whiteness and opacity of a base film, and the range of 15–30 wt % is more preferred.

Titanium dioxide may be used together with one or more white pigments that are selected from among inorganic pigments such as barium sulfate, silica, talc and calcium carbonate. These optional white pigments are preferably used in amounts that do not exceed 10 parts by weight per 100 parts by weight of the resin used in the present invention.

An example of the halogen atom which is represented by $R_1$–$R_5$ in formula (I) or $R_6$–$R_9$ in formula (II) is chlorine. An illustrative alkyl group is one having 1 -8 carbon atoms and it may be straight-chained or branched. Exemplary alkoxy groups are methoxy, propoxy and pentoxy. An illustrative dialkylamino group is diethylamino. The groups signified by $R_1$–$R_9$ may optionally have substituents. In formula (I), $R_1$–$R_4$ may be condensed to form a ring, and in formula (II), $R_6$ and $R_7$, and $R_8$ and $R_9$ may be condensed to form a ring. In formula (II), A represents —CH=CH—,

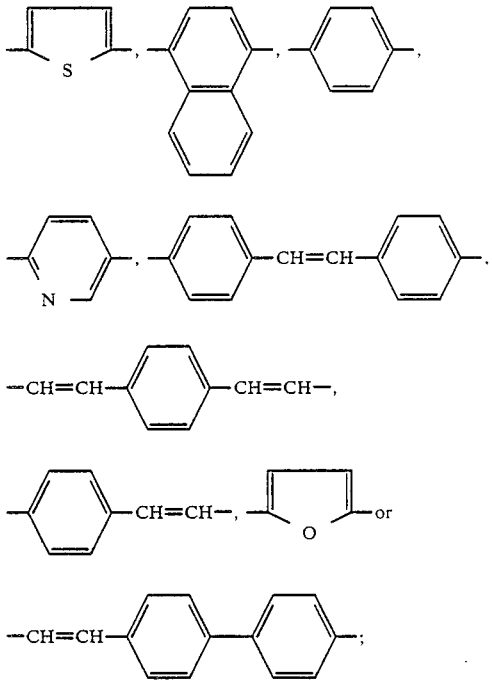

The compounds represented by formula (I) or (II) may be synthesized by any known method, such as the one disclosed in British Patent No. 1,100,579, and some of these compounds are commercially available.

The compound represented by formula (I) or (II) may be added at any stage of time up to film shaping, such as during polymerization for the production of polyester, during the time of mixing titanium oxide with the resin, or during film shaping. The compound may be added either in a powder or after being suspended in a suitable medium such as ethylene glycol.

Compounds represented by formula (I) or (II) may be employed either alone or in combination. These compounds are added in amounts of 0.01–1.0 part by weight, preferably 0.01–0.5 parts by weight, per 100 parts by weight of polyester resin. If the addition of these compounds is too small, they will not be able to attain satisfactory brightening effects or to produce improved weather resistance. The effects of these compounds will be saturated even if they are used in amounts that are greater than necessary.

Specific examples of the compounds represented by formulas (I) and (II) are listed below.

Illustrative compounds of formula (I):

(1)

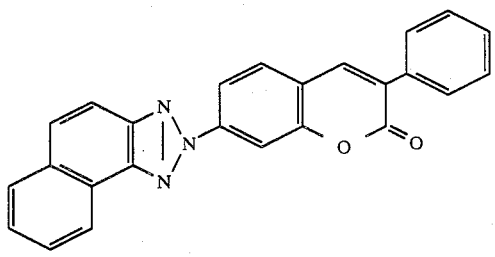

(2)

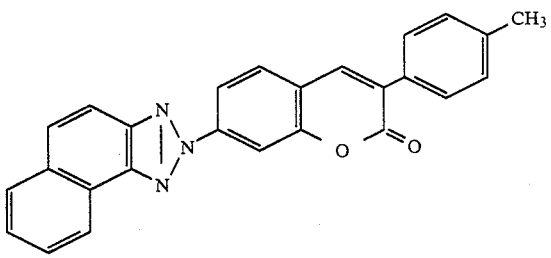

(3)

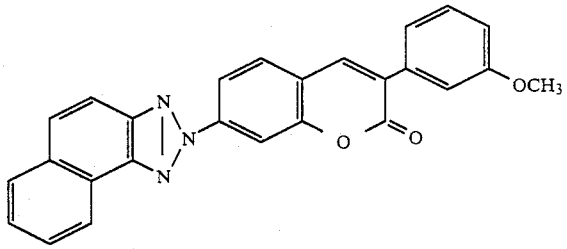

(4)

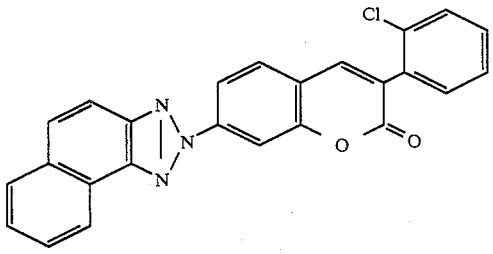

(5)

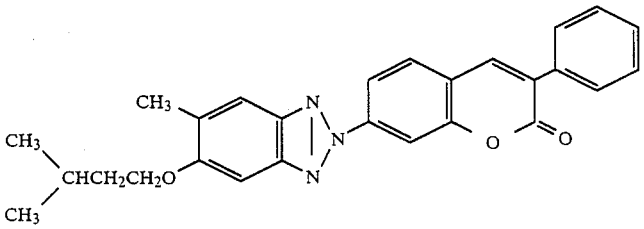

-continued
(6)
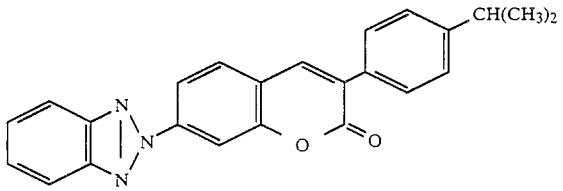
(7)
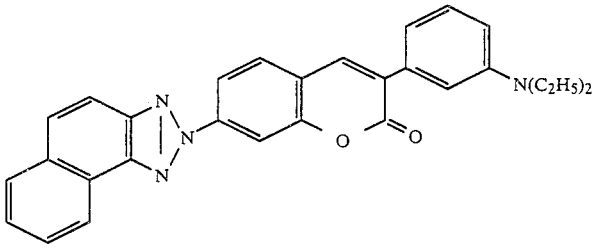
(The remaining space is left blank)
Illustrative compounds of formula (II):
(8)
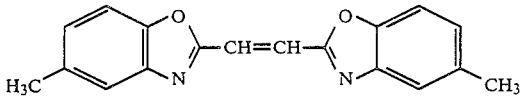
(9)
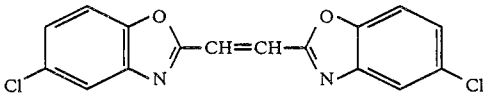
(10)
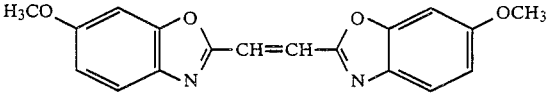
(11)
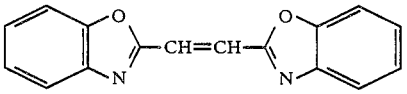
(12)
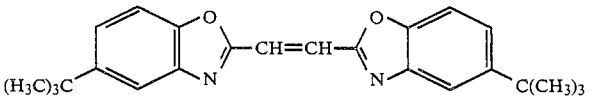
(13)
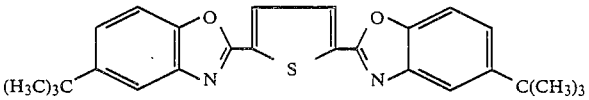
(14)
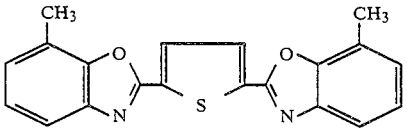
(15)
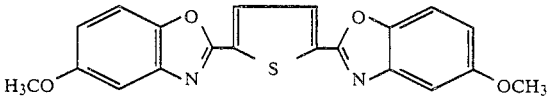

-continued
(16)
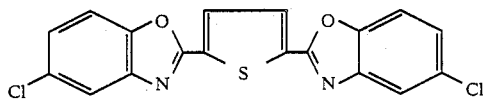
(17)
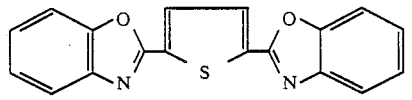
(18)
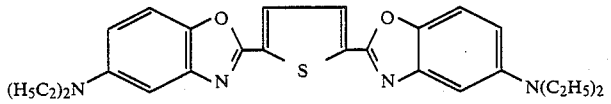
(19)
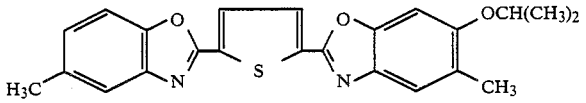
(20)
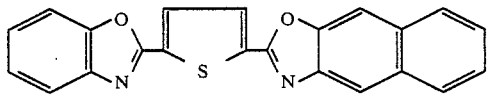
(21)
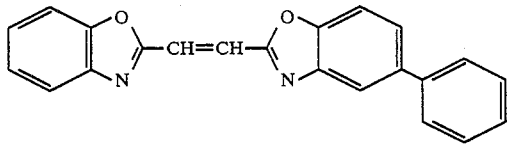
(22)
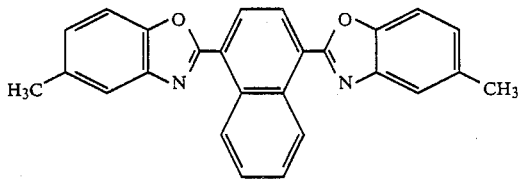
(23)
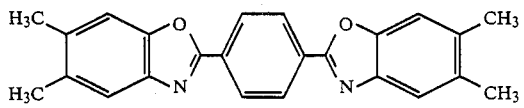
(24)
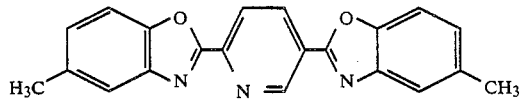
(25)
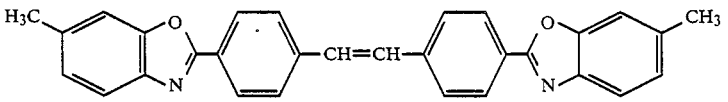
(26)
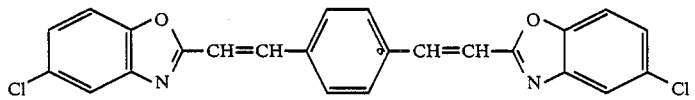
(27)
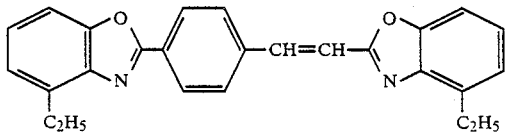

-continued (28)

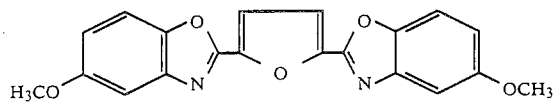

(29)

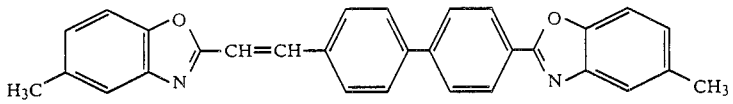

(The remaining space is left blank)

The photographic base of the present invention may contain conventional additives such as colorants (e.g., dyes), antioxidants and antistats provided that they do not have any detrimental effect on the objects of the present invention.

The photographic base of the present invention may be shaped by the following procedures: the resin defined in the present invention and to which titanium dioxide within the scope of the present invention is added is melted, extruded through a slit die, cast onto a chill surface such as a rotary drum to form an amorphous sheet, which is subsequently stretched biaxially (stretching in the longitudinal or transverse direction is followed by stretching in the transverse or longitudinal direction, or the film is stretched in the longitudinal and transverse directions simultaneously) at a temperature not lower than the glass transition temperature ($T_g$) of the resin and not higher than 130° C. In order to produce a film base that meets the requirements for high mechanical strength and dimensional stability, the stretching is preferably effected for a draw ratio of 4 to 16 on the basis of area. The stretched film is preferably heat-set and heat-relaxed.

The photographic base of the present invention has a thickness of 50–300 μm, preferably 75–250 μm. If the base is thinner than 50 μm, it does not have a sufficient body to withstand wrinkle formation. If the base is thicker than 300 μm, great inconvenience in handling will result.

The photographic base of the present invention is preferably adjusted to have a transmittance for all visible light of 20% or below, more preferably 10% or below, in order to ensure that it will be satisfactorily opaque and white when viewed with the eye.

The photographic base of the present invention which has been shaped, opacified and whitened by the procedures described above is then coated with a light-sensitive photographic emulsion layer on at least one side thereof. If necessary, the application of light-sensitive photographic emulsion layers may be preceded by a treatment for surface activation (e.g., corona treatment) and/or provision of subbing layers.

The base for reflection-photographic elements of the present invention may be used in any photographic elements that employs a base and it may be applied to either black-and-white photography or color photography. There is also no particular limitation on photographic structural layers, and light-sensitive photographic emulsion layers, intermediate layers, protective layers, filter layers, backcoat layers and other structural layers may be disposed in any number and in any order.

Any ordinary silver halide emulsion layers may be employed as photographic emulsion layers and preferred emulsions are silver chloride, silver bromide, silver chlorobromide, silver iodobromide and silver chloroiodobromide emulsions. Couplers for forming color image may be incorporated in these photographic emulsion layers. It is also possible to incorporate as binders non-gelatin hydrophilic polymers such as polyvinyl alcohol and polyvinyl pyrrolidone. The above-mentioned silver halide emulsion layers may be optically sensitized with suitable dyes such as cyanine and merocyanine dyes. Preferably, other photographic addenda such as anti-foggants, chemical sensitizers (e.g., those using gold and sulfur compounds), hardeners and antistats may be incorporated. Therefore, the photographic base of the present invention is effective not only in black-and-white development but also in color development using or without using a coupler.

The following examples are provided for the purpose of further illustrating the present invention but are in no way to be taken as limiting.

EXAMPLE 1

Pellets were made from a formulation consisting of 20 parts by weight of anatase titanium dioxide (average particle size; 0.3 μm) that had been surface-treated with alumina, silica and polydimethylsiloxane, and 100 parts by weight of a polyethylene terephthalate resin (intrinsic viscosity, 0.63). The pellets were mixed with 0.06 parts by weight of compound No. 1 (see the compound list incorporated herein; "Leucopur" EGM of Sandoz, Inc.) and the blend was extruded into an amorphous sheet about 1 mm thick. The sheet was first stretched at a draw ratio of 2.7 in the longitudinal direction at 110° C. and then at a draw ratio of 3.0 in the transverse direction at 120° C. The stretched sheet was heat-set at 210° C., cooled and taken up on a roll to form a white opaque bidirectionally stretched film with a thickness of 125 μm. This film is designated sample 1.

The whiteness and weather resistance of sample 1 were evaluated and the results are shown in Table 1. The methods of evaluation of the respective properties were as follows.

WHITENESS

Visually checked and rated in five scores.

A (good)→E (poor)

WEATHER RESISTANCE

The sample was held between two glass plates and exposed to sunshine for 50 days. The discoloration caused by the exposure was visually checked and rated in five scores.

A (discoloration was minimum and high degree of whiteness was maintained) → E (turned yellow and even brown)

In the evaluation of each factor, the sample was rejected as being unsuitable as a base for reflection-photographic elements when it was at either D or E level.

EXAMPLE 2

Sample 2 was prepared as in Example 1 except that anatase titanium dioxide was replaced by rutile titanium dioxide.

COMPARATIVE EXAMPLE 1

Sample 3 was prepared as in Example 1 except that compound No. 1 was replaced by the following compound:

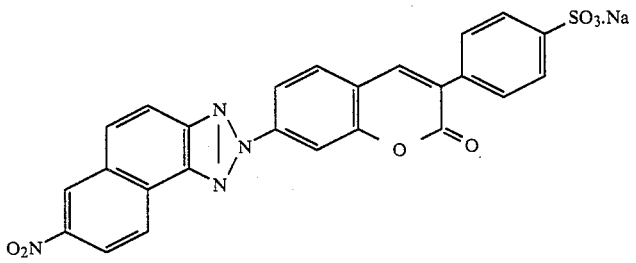

COMPARATIVE EXAMPLE 2

Sample 4 was prepared as in Example 1 except that anatase titanium dioxide was replaced by rutile titanium dioxide while compound No. 1 was replaced by the following compound:

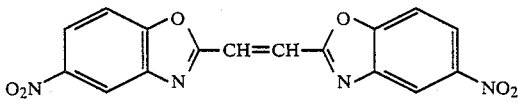

EXAMPLE 3

Sample 5 was prepared as in Example 1 except that compound No. 1 was replaced by compound No. 8.

EXAMPLE 4

Sample 6 was prepared as in Example 1 except that compound No. 1 was replaced by compound No. 13.

COMPARATIVE EXAMPLE 3

Sample 7 was prepared as in Example 2 except not containing compound No. 1.

COMPARATIVE EXAMPLE 4

Sample 8 was prepared as in Example 1 except not containing Compound No. 1.

The results of evaluation of the whiteness and weather resistance of sample Nos. 2 to 8 are shown in Table 1.

TABLE 1

| Sample No. | | Whiteness | Weather resistance |
|---|---|---|---|
| Invention | 1 | A | B |

TABLE 1-continued

| Sample No. | | Whiteness | Weather resistance |
|---|---|---|---|
| | 2 | C | A |
| Comparison | 3 | D | E |
| | 4 | E | A |
| Invention | 5 | A | B |
| | 6 | A | B |
| Comparison | 7 | E | B |
| | 8 | D | E |

As is clear from Table 1, comparative samples 3 and 8 were low in weather resistance and comparative samples 4 and 7 did not have a high degree of whiteness. Each of these comparative samples was unsuitable for use as a base for reflection-photographic elements. Sample 2 of the present invention was slightly inferior to sample 1 in terms of whiteness whereas sample 1 was a bit inferior to sample 2 in terms of weather resistance.

But both samples were found to be satisfactory for use as bases for reflection-photographic elements in practical applications and the improvement in their properties was pronounced as compared with comparative samples 3, 4, 7 and 8.

What is claimed is:

1. A base for reflection-photographic elements having a biaxially stretched film support, said film comprising polyester resin and titanium dioxide, wherein said film contains at least one compound represented by the following general formula (I) or (II):

(I)

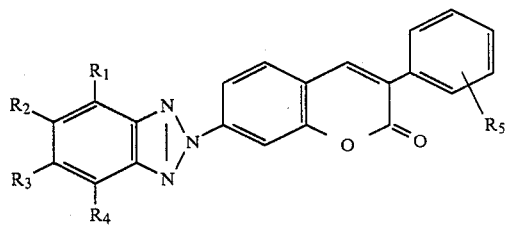

wherein $R_1$, $R_2$, $R_3$, $R_4$ and $R_5$ each represents a hydrogen atom, a halogen atom, an unsubstituted or substituted alkyl group, an alkoxy group, a dialkylamino group or an aryl group, provided that $R_1$, $R_2$, $R_3$ and $R_4$ may cooperate to form a ring.

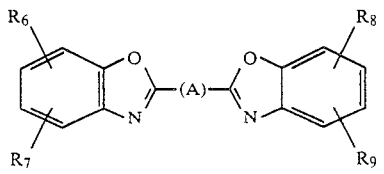

(II)

wherein A represents —CH=CH—,

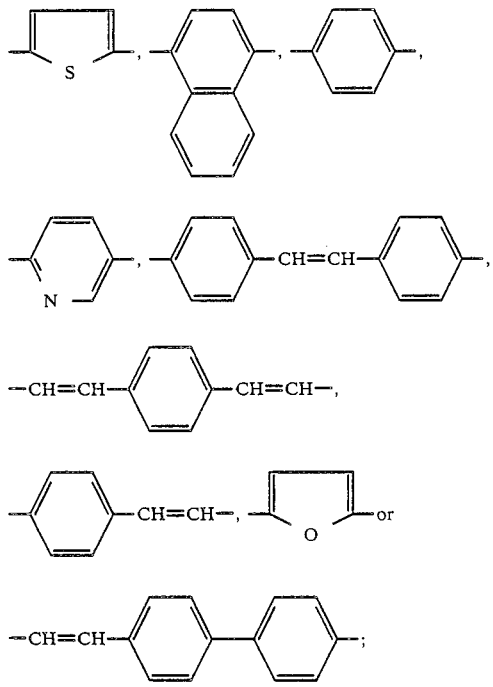

and $R_6$, $R_7$, $R_8$ and $R_9$ each represents a hydrogen atom, a halogen atom, an unsubstituted or substituted alkyl group, an alkoxy group, a dialkylamino group or an aryl group, provided that $R_6$ and $R_7$, and $R_8$ and $R_9$ each may cooperate to form a ring.

2. A base for reflection-photographic elements according to claim 1, wherein said titanium dioxide is of an anatase type.

3. A base for reflection photographic elements according to claim 1, wherein said alkyl group represented by each of $R_1$ to $R_9$ is an alkyl group having 1 to 8 carbon atoms.

4. A base for reflection-photographic elements according to claim 1, wherein said aryl group represented by each of $R_1$ to $R_9$ is a phenyl group.

5. A base for reflection-photographic elements according to claim 1, wherein said halogen atom represented by each of $R_1$ to $R_9$ is a chlorine atom.

6. A base for reflection photographic elements according to claim 1, wherein said alkoxy group represented by each of $R_1$ to $R_9$ is a propoxy group or a pentoxy group.

7. A base for reflection photographic elements according to claim 1, wherein said dialkylamino group represented by each of $R_1$ to $R_9$ is a diethylamino group.

8. A base for reflection photographic elements according to claim 1, wherein said polyester resin is a condensation product of an aromatic dicarboxylic acid and a glycol.

9. A base for reflection-photographic elements according to claim 8, wherein said aromatic dicarboxylic acid is selected from the group consisting of telephthalic acid, isophthalic acid, phthalic acid and naphthalenedicarboxylic acid.

10. A base for reflection-photographic elements according to claim 8, wherein said glycol is selected from the group consisting of ethylene glycol, 1,3-propandiol and 1,4-butanediol.

11. A base for reflection-photographic elements according to claim 8, wherein said polyester resin is selected from the group consisting of polyethyleneterephthalate, polyethylene-2,6-dinaphthalate, polypropileneterephthalate, and polybuthyleneterephthalate.

12. A base for reflection-photographic elements according to claim 1, wherein the intrinsic viscosity of said polyester resin measured at 20° C. in a mixed solvent is 0.5 to 0.8.

13. A base for reflection-photographic elements according to claim 1, wherein said titanium dioxide particles have an average particle diameter of 0.1 to 0.5 μm and do not contain particles whose diameter is more than 50 μm.

14. A base for reflection-photographic elements according to claim 1 or 2, wherein the surface of said titanium dioxide is treated with an alminium compound having an oxygen or hydrogen bond and/or a silica compound.

15. A base for reflection-photographic elements according to claim 1 or 2, wherein the ratio of said titanium dioxide particles in said polyester resin is 15 to 30 wt %.

16. A base for reflection-photographic elements according to claim 1, wherein said compound represented by formula (I) or (II) is used in an amount of 0.01 to 0.5 part by weight with respect to 100 parts by weight of polyester resin.

17. A base for reflection photographic elements according to claim 1, wherein said film is biaxially stretched at the ratio of 4 to 16 on the basis of area.

18. A base for reflection-photographic elements according to claim 1, wherein the thickness of said base is 75 to 250 μm.

19. A base for reflelction-photographic elements according to claim 1, wherein the percent transmission of all visible lights is less than 10%.

* * * * *